US005394225A

United States Patent [19]

Prker

[11] Patent Number: 5,394,225

[45] Date of Patent: Feb. 28, 1995

[54] OPTICAL SWITCHING SCHEME FOR SCD DONOR ROLL BIAS

[75] Inventor: Delmer G. Prker, Rochester, N.Y.

[73] Assignee: Xerox Corporation, Stamford, Conn.

[21] Appl. No.: 156,501

[22] Filed: Nov. 23, 1993

[51] Int. Cl.[6] ..... G03G 15/06

[52] U.S. Cl. ..... 355/259; 118/647; 118/651; 355/261

[58] Field of Search ..... 355/245, 246, 247, 259, 355/261, 262, 265; 118/651, 653, 654, 647, 648

[56] References Cited

U.S. PATENT DOCUMENTS

| | | | |
|---|---|---|---|
| 3,996,892 | 12/1976 | Parker et al. | 118/658 |
| 3,998,185 | 12/1976 | Weiler | 118/651 |
| 4,078,929 | 3/1978 | Gundlach | 96/1.2 |
| 4,282,303 | 8/1981 | Bergen | 118/651 X |
| 4,515,106 | 5/1985 | Kohyama | 118/651 |
| 4,568,955 | 2/1986 | Hosoya et al. | 346/153.1 |
| 4,647,179 | 3/1987 | Schmidlin | 355/262 |
| 4,868,600 | 9/1989 | Hays et al. | 355/259 |
| 4,994,859 | 2/1991 | Mizuno et al. | 355/247 |
| 5,010,367 | 4/1991 | Hays | 355/247 |
| 5,031,570 | 7/1991 | Hays et al. | 118/654 |
| 5,172,170 | 12/1992 | Hays et al. | 355/259 |
| 5,289,240 | 2/1994 | Wayman | 355/259 |

*Primary Examiner*—William J. Royer

[57] ABSTRACT

A non-interactive or scavengeless development system for use in color imaging. To control the developability of lines and the degree of interaction between the toner and receiver, an AC voltage is applied between a donor roll and two sets of interdigitated electrodes embedded in the surface of the donor roll to enable efficient detachment of toner from the donor to form a toner cloud. An optical switching arrangement effects an electrical connection between a slip ring and one set of interdigitated electrodes.

16 Claims, 4 Drawing Sheets

OPTICAL SWITCHING SCHEME FOR SCD DONOR ROLL BIAS

BACKGROUND OF THE INVENTION

This invention relates generally to the rendering of latent electrostatic images visible. More particularly, the invention relates to non-interactive or scavengeless development systems and a method and apparatus for commutating power to electrodes of a toner donor roll which minimizes commutator induced wear of the electrodes.

The invention can be utilized in the art of xerography or in the printing arts. In the practice of conventional xerography, it is the general procedure to form electrostatic latent images on a xerographic surface by first uniformly charging a photoreceptor. The photoreceptor comprises a charge retentive surface. The charge is selectively dissipated in accordance with a pattern of activating radiation corresponding to original images. The selective dissipation of the charge leaves latent charge patterns on the imaging surface corresponding to the areas not exposed by radiation.

This charge pattern is made visible by developing it with toner. The toner is generally a colored powder which adheres to the charge pattern by electrostatic attraction.

The developed image is then fixed to the imaging surface or is transferred to a receiving substrate such as plain paper to which it is fixed by suitable fusing techniques.

The invention is particularly useful in highlight color imaging such as tri-level imaging. The concept of tri-level, highlight color xerography is described in U.S. Pat. No. 4,078,929 issued in the name of Gundlach. The patent to Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught in the '929 patent, the xerographic contrast on the charge retentive surface or photoreceptor is divided into three levels, rather than two levels as is the case in conventional xerography. The photoreceptor is charged, typically to −900 volts. It is exposed imagewise, such that one image corresponding to charged image areas (which are subsequently developed by charged-area development, i.e. CAD) stays at the full photoreceptor potential ($V_{cad}$ or $V_{ddp}$). The other image is exposed to discharge the photoreceptor to its residual potential, i.e. $V_{dad}$ or $V_c$ (typically −100 volts) which corresponds to discharged area images that are subsequently developed by discharged-area development (DAD) and the background areas exposed such as to reduce the photoreceptor potential to halfway between the $V_{cad}$ and $V_{dad}$ potentials, (typically −500 volts) and is referred to as $V_{white}$ or $V_w$. The CAD developer is typically biased about 100 volts closer to $V_{cad}$ than $V_{white}$ (about −600 volts), and the DAD developer system is biased about 100 volts closer to $V_{dad}$ than $V_{white}$ (about −400 volts).

The viability of printing system concepts such as tri-level, highlight color xerography requires development systems that do not scavenge or interact with a previously toned image. Since commercial development systems such as conventional magnetic brush development and jumping single component development interact with the image receiver, a previously toned image will be scavenged by subsequent development. Since the present commercial development systems are highly interactive with the image bearing member, there is a need for scavengeless or non-interactive development systems.

The present invention is especially suited for use in scavengeless single component development (SCD) systems wherein a confined toner cloud is formed in a 250 micron development zone gap by applying an AC bias of several hundred volts to one or more small diameter wire electrodes carried by a toner donor roll positioned adjacent a photoreceptor. The AC bias, which has a frequency is in the kilohertz range, acts upon the charged toner to induce a mechanical agitation which is sufficient to overcome adhesive forces that hold toner to the donor roll. Once freed, the toner is readily available to develop the electrostatic latent image on the photoreceptor.

In earlier renderings of this type of development system, the electrodes consisted of taut wires supported intermediate a photoreceptor and a toner donor roll. See for example U.S. Pat. No. 5,010,367 granted to Dan A. Hays on Apr. 23, 1991. Unfortunately, it has proven difficult to devise a mechanical design for the fragile taut wire array that is both robust, and free of development artifacts. For example, the wires tend to entrap toner agglomerates and spurious paper fibers which can cause streaks in the developed image.

The problems attendant taut wires may be obviated by using an array of small diameter wires or electrodes embedded in the surface of the donor roll. In this approach, the AC bias is applied to the wires in the development zone through commutating brushes at the ends of the donor roll. Such a construction is described in U.S. Pat. No. 3,996,892 granted to Parker et al on Dec. 14, 1976. The '892 granted to Parker et al on Dec. 14, 1976 discloses a spatially programmable electroded donor roll wherein an DC voltage is applied to the wire electrodes in the development nip or zone, pre-nip and post-nip zones through commutating brushes at the ends of the donor roll. Such an arrangement allows the bias profile around the circumference of a two component magnetic brush development roll to be tailored in a way that promotes good development. Thus, a pre-nip voltage of 100 volts, a nip voltage of 250 to 300 volts and a post-nip voltage of 1000 volts are provided. The electrodes on the donor roll were constructed by first plating a thin layer of copper on the outer surface a phenolic roll, and then by etching 0.01" wide electrode strips, on 0.02 centers, axially along the length of the roll. Next, the roll was overcoated with a semi-conductive rubber sheath, except for a short length at the ends where the bias was applied to the electrodes through commutating bushes. The voltage profile around the circumference of the roll was determined by the IR voltage drop due to current flow through the semi-conductive sheath from one or commutator to another. Such a construction is know to have had problems with wear and pitting of the thin electrodes where they made contact with the commutating brushes. Nickel plating the electrodes helped alleviate the wear problem somewhat, but the electrode damage problem was never completely solved.

The '892 patent, in a second embodiment, discloses the use of a ring-like resistive member mounted for rotation with a donor roll. A plurality of stationarily mounted electrical contacts ride on the ring-like member which, in turn, is seated on the coating free portions of conductors and mounted for rotation with a sleeve upon which the conductors are carried.

U.S. Pat. No. 4,568,955 granted to Hosoya also discloses a development or donor roll having electrode structures incorporated therein. Copper electrode structures are deposited on the insulated surface of a donor roll. In one rotational position of the Hosoya et al donor roll, a DC voltage is supplied to alternate ones of the copper electrodes while an AC voltage is supplied to the electrodes intermediate the electrodes having the DC voltage applied thereto. In another rotational position of this donor roll the AC and DC voltages are applied to the opposite electrodes. In other words, each electrode when positioned in the development nip first has one kind of voltage applied and then the other. The AC voltage establishes an alternating electric field for liberating toner particles on the surface of the donor roll. According to the Hosoya et al description, when the AC voltage is greater than the DC voltage the toner particles move from one electrode to an adjacent electrode and when the AC voltage is less than the DC voltage the toner particles move in the opposite direction between two adjacent electrodes.

U.S. Pat. No. 5,031,570 granted to Hays et al on Jul. 16, 1991 and assigned to the same assignee as the instant application discloses a scavengeless development system for use in highlight color imaging. AC biased electrodes positioned in close proximity to a magnetic brush structure carrying a two-component developer cause a controlled cloud of toner to be generated which non-interactively develops an electrostatic image. The two-component developer includes mixture of carrier beads and toner particles. By making the two-component developer magnetically tractable, the developer is transported to the development zone as in conventional magnetic brush development where the development roll or shell of the magnetic brush structure rotates about stationary magnets positioned inside the shell.

U.S. Pat. No. 4,868,600 granted to Hays et al on Sep. 19, 1989 discloses a scavengeless development system in which toner detachment from a donor and the concomitant generation of a controlled powder cloud is obtained by AC electric fields supplied by self-spaced electrode structures positioned within a development nip. The electrode structure is placed in close proximity to the toned donor within the gap or nip between the toned donor and image receiver, self-spacing being effected via the toner on the donor. Such spacing enables the creation of relatively large electrostatic fields without risk of air breakdown.

U.S. Pat. No. 5,010,367 granted to Dan A. Hays on Apr. 23, 1991 discloses a scavengeless/non-interactive development system for use in highlight color imaging. To control the developability of lines and the degree of interaction between the toner and receiver, the combination of an AC voltage on a developer donor roll with an AC voltage between toner cloud forming wires and donor roll enables efficient detachment of toner from the donor to form a toner cloud and position one end of the cloud in close proximity to the image receiver for optimum development of lines and solid areas without scavenging a previously toned image.

U.S. patent application Ser. No. 07/724,242 filed on Jul. 1, 1991 in the name of Dan A. Hays and assigned to the same assignee as the instant application discloses a scavengeless or non-interactive development system for use in image formation such as highlight color imaging. A toned donor roll structure having two sets of interdigitated electrodes physically supported by an insulative support structure is provided. Both sets of electrodes have a DC bias applied thereto while the other set has an AC bias applied thereto. The AC and DC biases are such as to preclude background development without creating fringe DC fields between adjacent electrodes.

U.S. Pat. No. 5,172,170 granted to Hays et al on Dec. 12, 1992 relates to an apparatus in which a donor roll advances toner to an electrostatic latent image recorded on a photoconductive member. A plurality of electrical conductors are located in grooves in the donor roll. The electrical conductors are spaced from one another and adapted to be electrically biased in the development zone to detach toner from the donor roll so as to form a toner cloud in the development zone. In the development zone, toner is attracted from the toner cloud to the latent image. In this way, the latent image is developed with toner.

BRIEF SUMMARY OF THE INVENTION

In accordance with the present invention, an aerosol layer of toner is formed using an interdigitated donor electrode structure including at least two sets of embedded electrodes supported in close proximity to a toner layer on the surface of a donor structure. An AC potential is applied to both sets of electrodes. The AC is applied to all of the electrodes of one set while it is selectively applied to only some of the electrodes of the other set. The selective application is effected in a development zone.

To minimize wear and tear on the embedded electrodes one set of the interdigitated wire electrodes makes contact with a continuous slip ring at one end of the donor roll. The other set of electrodes is electrically connected to a similar slip ring on the opposite end of the donor roll through a strip of photoconductive material such as selenium or amorphous silicon. The AC bias is applied to the slip rings at each end of the donor roll through commutating brushes. In the dark, the photoconductive strip electrically isolates one set of the wire electrodes from the AC bias voltage. Electrodes embedded in the rotating donor roll can be electrically connected to the AC bias voltage as they pass through the development zone by illuminating the appropriate region of the photoconductor with a collimated beam of light.

DETAILED DESCRIPTION OF THE PREFERRED EMBODIMENT OF THE INVENTION

Figure 4:
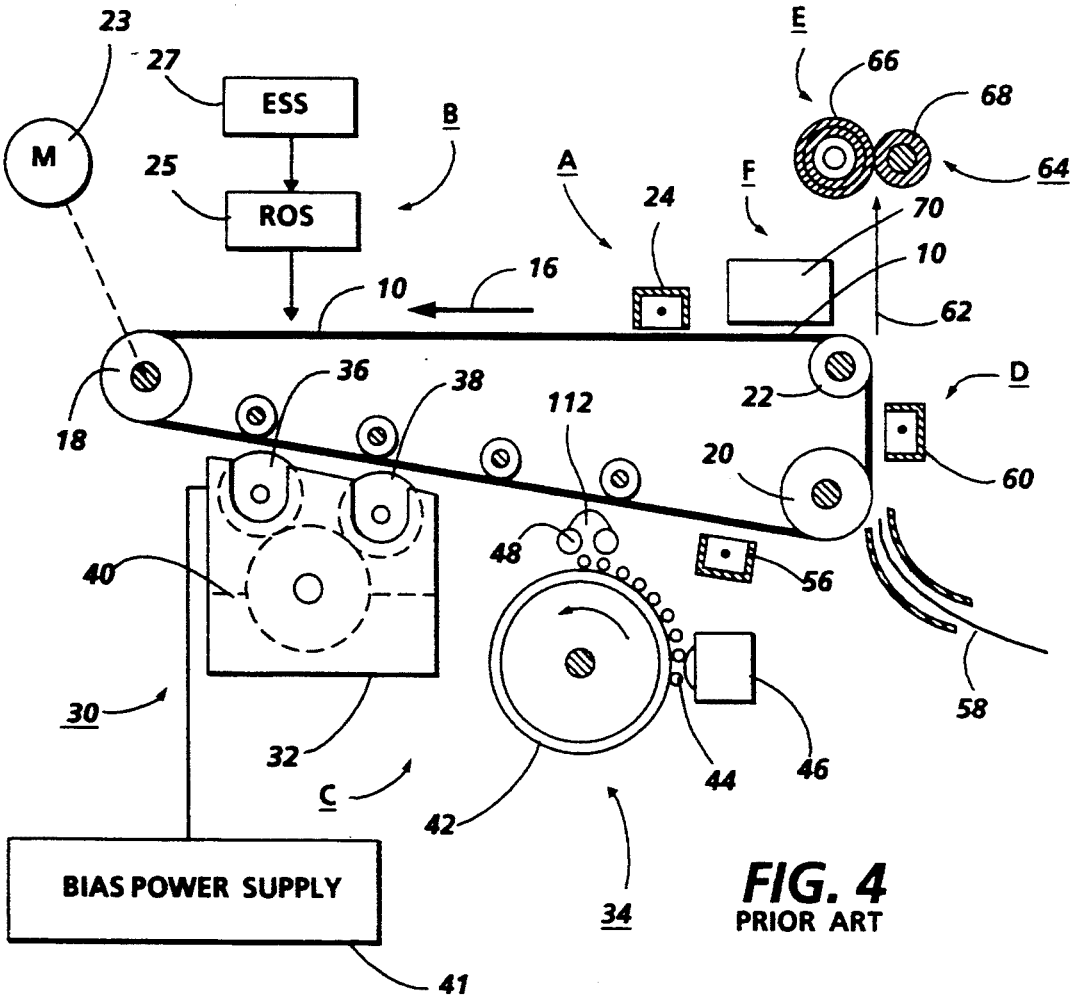
FIG. 4 PRIOR ART
FIG. 4 is schematic illustration of a printing apparatus incorporating the inventive features of the invention.

As shown in FIG. 4, a highlight color printing machine of the prior art in which the invention may be utilized comprises a charge retentive member in the form of a photoconductive belt 10 consisting of a photoconductive surface and an electrically conductive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 4, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_O$. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device. Preferably the scanning device is a three level laser Raster Output Scanner (ROS). Alternatively, the ROS could be replaced by a conventional xerographic exposure device. An electronic subsystem (ESS) 27 provides for control of the ROS as well as other subassemblies of the machine.

The photoreceptor, which is initially charged to a voltage $V_O$, undergoes dark decay to a level $V_{ddp}$ equal to about −900 volts. When exposed at the exposure station B it is discharged to $V_c$ equal to about −100 volts which is near zero or ground potential in the highlight (i.e. color other than black) color parts of the image. The photoreceptor is also discharged to $V_w$ equal to approximately −500 volts imagewise in the background (white) image areas.

At development station C, a development system, indicated generally by the reference numeral 30 advances developer materials into contact with the electrostatic latent images. The development system 30 comprises first and second developer apparatuses 32 and 34. The developer apparatus 32 comprises a housing containing a pair of magnetic brush rollers 36 and 38. The rollers advance developer material 40 into contact with the latent images on the charge retentive surface which are at the voltage level $V_c$ The developer material 40 by way of example contains color toner and magnetic carrier beads. Appropriate electrical biasing of the developer housing is accomplished via power supply 41 electrically connected to developer apparatus 32. A DC bias of approximately −400 volts is applied to the rollers 36 and 38 via the power supply 41. With the foregoing bias voltage applied and the color toner suitably charged, discharged area development (DAD) with colored toner is effected.

The second developer apparatus 34 comprises a donor structure in the form of a roller 42. The donor structure 42 conveys developer 44, which in this case is a single component developer comprising black toner deposited thereon via a combination metering and charging device 46, to an area adjacent an electrode structure. The toner metering and charging can also be provided by a two component developer system such as a magnetic brush development structure. The donor structure can be rotated in either the 'with' or 'against' direction vis-a-vis the direction of motion of the charge retentive surface. The donor roller 42 is preferably coated with TEFLON-S (trademark of E. I. DuPont De Nemours) or anodized aluminum.

The developer apparatus 34 further comprises an electrode structure 48 which is disposed in the space between the charge retentive surface 10 and the donor structure 42. The electrode structure is comprised of one or more thin (i.e. 50 to 100 μm diameter) tungsten wires which are positioned closely adjacent the donor structure 42. The distance between the wires and the donor is approximately 25 μm or the thickness of the toner layer on the donor roll. Thus, the wires are self-spaced from the donor structure by the thickness of the toner on the donor structure. For a more detailed description of the foregoing, reference may be had to U.S. Pat. No. 4,868,600 granted to Hays et al on Sep. 19, 1989.

A sheet of support material 58 (FIG. 4) is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

Because the composite image developed on the photoreceptor consists of both positive and negative toner, a positive pre-transfer corona discharge member 56 is provided to condition the toner for effective transfer to a substrate using negative corona discharge.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute, not shown, guides the advancing sheet 68 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. A magnetic brush cleaner housing 70 is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush.

Subsequent to cleaning, a discharge lamp (not shown) floods the photoconductive surface with light to dissipate any residual electrostatic charge remaining prior to the charging thereof for the successive imaging cycle.

Figure 1:
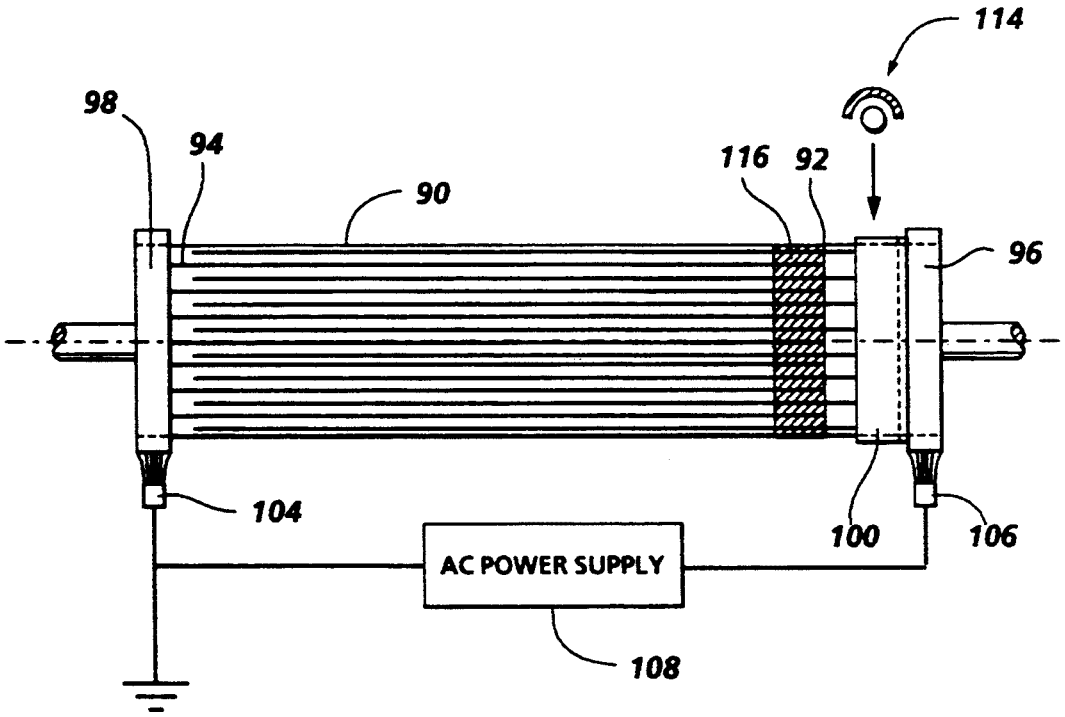
FIG. 1 is a fragmentary schematic view of a development structure according to the present invention.
Figure 2:
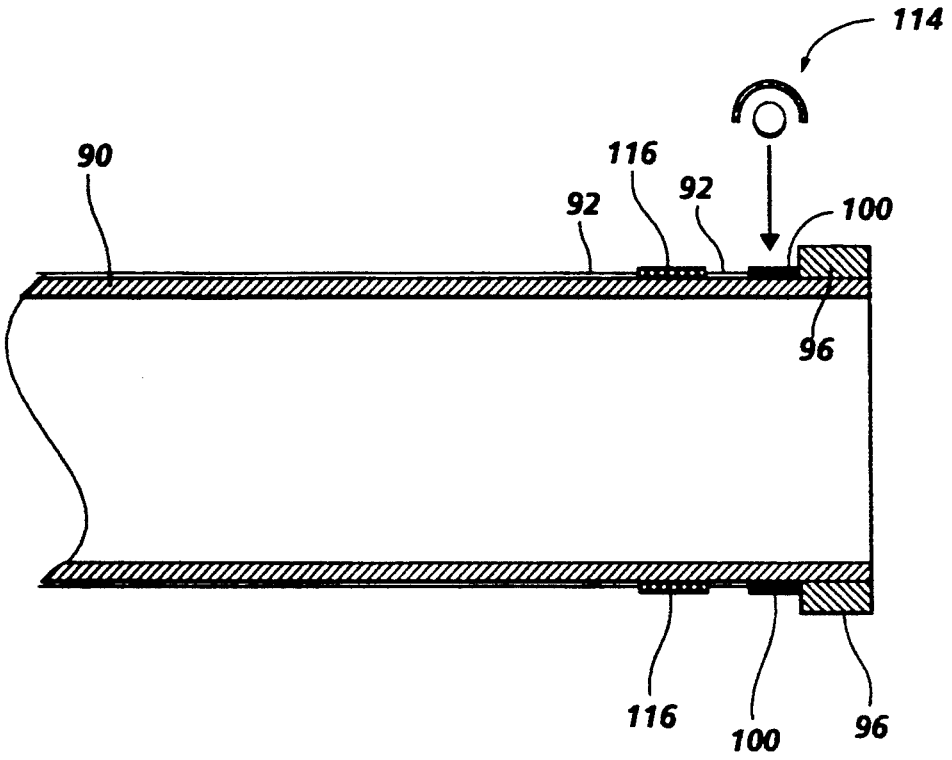
FIG. 2 is a partial fragmentary schematic view of the development structure of FIG. 1.

A donor roll structure 90 directed to the features of this invention is illustrated in FIG. 1. As shown therein, the donor roll structure comprises two sets of interdigitated electrodes 92 and 94. The two sets of electrodes are embedded in the surface of the donor roll structure 90. The ends of the set of electrodes 94 contact a slip ring 98 at one end of the donor roll structure. The other set 92 of electrodes is electrically connected to a similar slip ring 96 on the opposite end of the donor roll structure through a strip 100 (FIG. 2) of photoconductive material such as selenium or amorphous silicon which completely encompasses the donor roll structure.

An AC bias voltage supply 108 is applied to the slip rings 96 and 98 at each end of the donor roll structure through commutating brushes 104 and 106. Robust slip rings may be obtained by pressing heavy copper rings over the ends of the donor roll structure.

In the dark, the photoconductive strip 100 electrically isolates the set of the wire electrodes 92 from the AC bias voltage. The set of electrodes 92 are electrically connected to the AC bias voltage as they pass through a development zone 112 (FIG. 4) by illuminating the photoconductive strip with a beam of light from a collimated light source 114. To this end, the photoconductive strip which extends about the entire circumference of the donor roll structure contacts the set of electrodes 92 as well as the slip ring 96. The AC bias may comprise the secondary winding of a transformer where the AC biases applied to the two sets of electrodes are derived from opposite ends of the secondary winding to provide two phase shifted AC biases for biasing the two sets of electrodes. The AC bias may have a DC component superimposed on it.

Illumination of the photoconductive strip with the light source 114 is restricted to a portion thereof which is positioned in a development zone 112 (FIG. 4) intermediate the donor roll structure 90 and the imaging belt 10. This arrangement of collimated light source and photoconductive strip provides an optical switching device for simultaneously energizing of both sets of electrodes only in the development zone 112.

Alternatively, optical switching may be effected on the inside of the donor roll structure 90. In this case, it would be necessary to locate the light source and photoconductive ring on the inside of the donor roll with the electrodes brought inside by "solder through the hole" techniques.

The width of the photoconductive strip between the electrodes of the set 92 and the slip ring 96 is such as to withstand the maximum AC bias voltage without breakdown, and also provide a dark impedance that is large compared to the capacitive reactance of the unactivated electrodes at the ac bias frequency. Because the electrical capacitance of the wire electrode array is small, this latter requirement might be hard to satisfy unless the capacity of the individual wire electrodes to adjacent electrodes (or ground as the case may be) is shunted by an appropriate resistance, $R_s$ provided by a continuous resistor 116 contacting all of the electrodes of both electrode sets. The value of $R_s$ should be such that:

Rs << photoconductor dark resistance and

Rs = ~10× the illuminated photoconductor resistance

A shunting resistor that satisfies these conditions will force the bias voltage drop to appear across the non-illuminated portions of the photoconductor strip but will permit essentially the full AC bias to be applied to the electrodes when the portion of the photoconductor in series with the electrode is illuminated. Thus, only those electrodes positioned in the development zone will have the full AC bias applied thereto.

A suitable resistor can be made by depositing or painting a resistive material over the electrodes around the circumference of the donor roll at one, or both ends of the roll as shown in FIG. 1.

Figure 3:
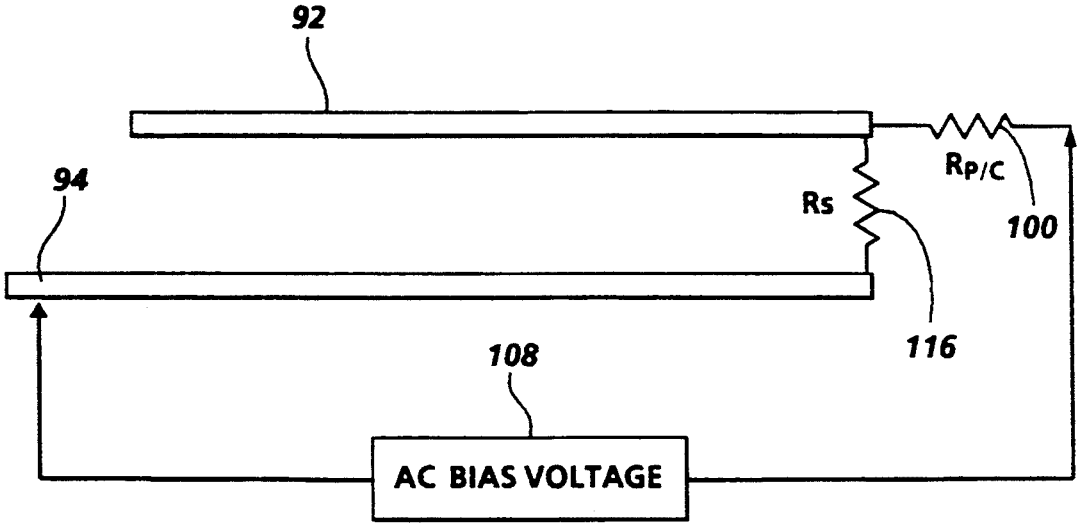
FIG. 3 is an electrical schematic depicting the electrical equivalent of the donor roll structure of the present invention.

As an example, assume a dark photoreceptor resistance of 107 ohms, an illuminated photoreceptor resistance of $10^5$ ohms, and a shunt resistor resistance of $10_6$ ohms. FIG. 3 represents the equivalent circuit for the photoconductor/dark and photoconductor/illuminated cases respectively. When the photoconductor is in the dark, the ratio of the photoconductor resistance ($R_{p/c}$) to the shunt resistance (Rs) is 10:1, and so ~90% of the AC bias voltage will appear across the photoconductor and only about 10% across the shunt resistor. If the AC bias voltage is 500 volts, the resulting 50 volt drop across Rs (which is also across the electrodes) is insufficient to excite the toner cloud.

On the other hand, when the photoconductor is illuminated, the ratio of $R_{p/c}$ to Rs is 1:10, and nearly all of the AC bias voltage will appear across Rs and the electrodes.

The $1^2R$ power dissipation in the shunt resistor is given by $E^2/R$. For a 500 volt AC bias and Rs=106 ohms, the power loss in Rs when the photoconductor is illuminated will be 250 milliwatts. However, because the full bias voltage is present across $R_s$ only when it is in the development zone, the average power dissipation in $R_s$ will be much less than 250 milliwatts. Power dissipation in $R_s$ and $R_{p/c}$ will be negligible when the photoconductor is in the dark because of the high dark resistance of the photoconductor.

Although the optical bias voltage switching scheme is described here in the context of interdigitated wire electrodes, it is equally applicable to other arrangements such as an embedded wire array on the outside of the donor roll and a continuous electrode on the inside. The proposed optical switching scheme need not be limited to the scavengeless SCD type systems, but could be employed in any commutated bias scheme such as that taught in U.S. Pat. No. 3,996, 892.

What is claimed is:

1. A donor structure for developing latent electrostatic images on a charge retentive surface with toner particles, said structure comprising:

two sets of interdigitated electrodes carried by said donor structure;

a source of electrical power;

means for effecting movement of said structure in an endless path such that a surface thereof passes through a development zone intermediate said charge retentive surface and said donor structure;

means for electrically connecting said source of power to one set of said electrodes;

means carried by the surface of said donor structure and a member supported stationarily adjacent said donor structure for electrically connecting said source of power to the other set of electrodes whereby said source of electrical power can be selectively applied to said other set of electrodes whereby electrical power is applied to both sets of electrodes simultaneously.

2. Donor structure according to claim 1 wherein said means carried by the surface of said donor structure comprises a plurality of members adapted to cooperate with said member supported adjacent said donor structure for providing an electrical connection between said other set of electrodes and said source of electrical power.

3. Donor structure according to claim 2 wherein said means carried by said donor structure comprises a light actuatable element.

4. Donor structure according to claim 3 wherein said light actuatable element comprises a photoconductive strip.

5. Donor structure according to claim 1 wherein said source of power comprises AC.

6. Donor structure according to claim 5 wherein said means carried by the surface of said donor structure comprises a plurality of members adapted to cooperate with said member supported adjacent said donor structure for providing an electrical connection between said other set of electrodes and said source of electrical power.

7. Donor structure according to claim 6 wherein said means carried by said donor structure comprises a light actuatable element.

8. Donor structure according to claim 7 wherein said light actuatable element comprises a photoconductive strip.

9. Donor structure according to claim 8 wherein AC power is applied in said development zone to a predetermined number of electrodes of said other set of electrodes.

10. Donor structure according to claim 9 wherein said donor structure comprises a roll.

11. Donor structure according to claim 10 wherein said means carried by said donor structure comprises a slip ring.

12. Donor structure according to claim 11 wherein said means for electrically connecting said source of AC power to said one set of said electrodes comprises a slip ring.

13. Donor structure according to claim 12 wherein said member supported adjacent said donor structure comprises a source of collimated light for illuminating a predetermined portion of said photoconductive strip.

14. Donor structure according to claim 13 wherein said means carried by said donor structure further comprises an impedance member for forcing a bias voltage drop to appear across non-illuminated portions of the photoconductive strip but permitting essentially a full AC bias to be applied to said other set of electrodes when the portion of the photoconductive strip in series with said other set of electrodes is illuminated.

15. Donor structure according to claim 13 wherein said photoconductive strip is carried on the outer surface of said donor structure and said source of collimated light is supported adjacent said outer surface.

16. Donor structure according to claim 15 wherein said means carried by said donor structure further comprises an impedance member for forcing a bias voltage drop to appear across non-illuminated portions of the photoconductive strip but permitting essentially a full AC bias to be applied to said other set of electrodes when the portion of the photoconductive strip in series with said other set of electrodes is illuminated.

* * * * *